US005627428A

United States Patent [19]

Helbig et al.

[11] Patent Number: 5,627,428

[45] Date of Patent: May 6, 1997

[54] SINGLE-BASED HIGH-PRESSURE DISCHARGE LAMP PARTICULARLY FOR AUTOMOTIVE-TYPE HEADLIGHTS

[75] Inventors: Peter Helbig, Sontheim; Gerhard Behr, Altheim; Claus Regitz, Overath; Hans-Juergen Keck, Berlin, all of Germany

[73] Assignee: Patent-Treuhand-Gesellschaft F. Elektrisohe Cluehlampen mbH, Munich, Germany

[21] Appl. No.: 495,719

[22] Filed: Jun. 27, 1995

[30] Foreign Application Priority Data

Aug. 4, 1994 [DE] Germany ..... 44 27 593

[51] Int. Cl.[6] ..... H01J 5/48; F21M 7/00

[52] U.S. Cl. ..... 313/318.01; 313/318.09; 313/318.1; 439/611

[58] Field of Search ..... 313/318.01, 318.03, 313/318.08, 318.09, 318.1, 113, 25; 439/602, 611; 362/263, 310

[56] References Cited

U.S. PATENT DOCUMENTS 4,795,939 1/1989 Eckhardt et al. ..... 313/318.01
5,253,153 10/1993 Mathews et al. ..... 362/310
5,270,610 12/1993 Schoenherr et al. ..... 313/318.01
5,428,261 6/1995 Wittig et al. ..... 313/318.1
5,495,138 2/1996 Behr et al. ..... 313/318.01

FOREIGN PATENT DOCUMENTS 0321866 6/1989 European Pat. Off. .
WO94/28576 12/1994 WIPO .

*Primary Examiner*—Sandra L. O'Shea
*Assistant Examiner*—Ashok Patel
*Attorney, Agent, or Firm*—Frishauf, Holtz, Goodman, Langer & Chick, P.C.

[57] ABSTRACT

To reliably and simply connect one end of a double-ended discharge vessel unit (1) and a surrounding envelope (11) to a base (8), the base has a base sleeve (8*a*) which encloses a base holder portion (8*b*). The envelope (11) is melt-connected to the discharge vessel unit (1), for example just beyond pinch seals formed thereon, and is additionally formed with an extension (11*a*) which is, in turn, melt-connected to the holder portion (8*b*) of the base. Preferably, a metallic cuff is placed within the holder portion so that, by high-frequency inductive heating, a reception region (8*d*) of the holder portion can melt and tightly grip the extension (11*a*) of the envelope. To improve adhesion, the surface of the extension region (11*a*) may be ribbed, knurled or otherwise, slightly deformed.

4 Claims, 1 Drawing Sheet

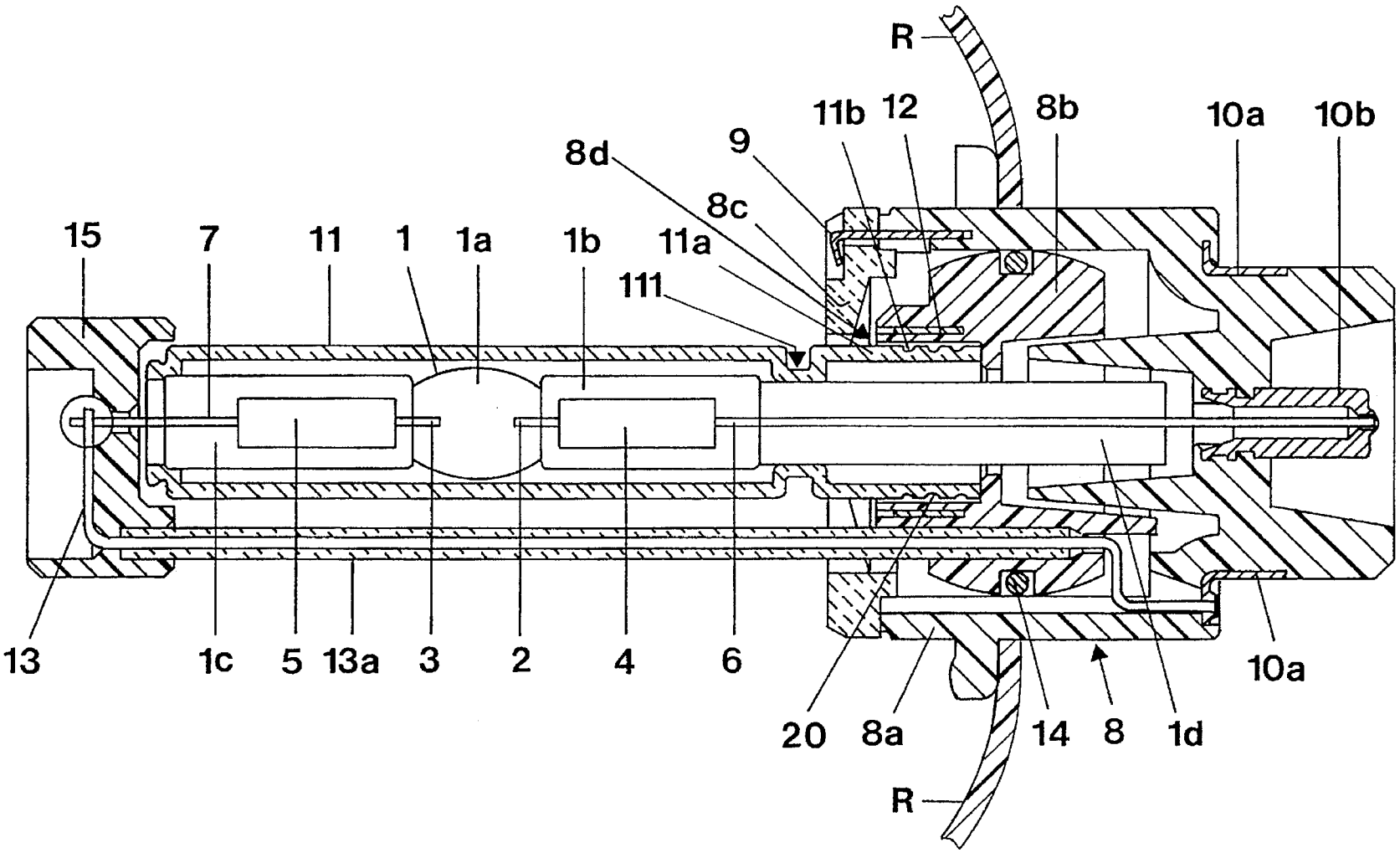
10b
10a
8b
R
12
11b
9
8c
8d
11a
111
1b
1a
1
11
7
15
13
1c
5
13a
3
2
4
6
20
8a
R
14
8
1d
10a

SINGLE-BASED HIGH-PRESSURE DISCHARGE LAMP PARTICULARLY FOR AUTOMOTIVE-TYPE HEADLIGHTS

Reference to related patents and applications, the disclosures of which are hereby incorporated by reference:

U.S. Pat. No. 5,270,610, Schoenherr et al., assigned to the assignee of the present application;

U.S. Pat. No. 5,253,153, Mathews et al;

International Application, United States designated, PCT/DE94/00600, published under WO 94/28576, Wittig et al.;

Reference to related publication, assigned to the assignee of the present invention:

European Published Application 0 321 866 A2, Gaugel.

FIELD OF THE INVENTION

The present invention relates to a high-pressure discharge lamp, which has a single base, and which is particularly suitable for use in mobile applications, especially for automotive headlights.

BACKGROUND

U.S. Pat. No. 5,270,610, Schoenherr et al., the disclosure of which is hereby incorporated by reference, describes a double-ended, single-based electric lamp. The vitreous bulb of the lamp is formed with a tubular extension which is melt-sealed within a holder portion. The holder portion is adjustable to adjust the position of the bulb with respect to the base, so that, when the base is secured to, or within a reflector, the position of the lamp can be properly adjusted for desired optical characteristics of the lamp-reflector combination. The light source itself is formed as a single-based high-pressure discharge lamp especially suitable for automotive applications; the lamp bulb or lamp vessel, and the discharge vessel or portion of the lamp, are especially suited for automotive use. This lamp does not have an outer envelope which reduces ultraviolet (UV) radiation emitted from the lamp during operation thereof.

International Application PCT/DE94/00600, published as WO 94/28576 (United States designated), Wittig, et al., assigned to the assignee of the present application, describes a high-pressure discharge lamp and, especially, a single-based high-pressure discharge lamp particularly adapted for use in an automotive headlight. The lamp has a double-ended sealed discharge vessel surrounded by an outer envelope or shroud. The outer envelope is melt-sealed to the discharge lamp itself in the region of pinch seals of the discharge vessel, and positioned outside of the base. The base-adjacent end of the discharge vessel is formed with a tubular extension similar to the lamp described in connection with the above referred to reference U.S. Pat. No. 5,270,610, Schoenherr et al., which, in turn, is melted into an adjustable holder portion within the base.

It has been found that the relatively thin tubular extension in the region between the outer envelope and the base might fracture when the lamp is subjected to shock or vibration.

European Published Application EP 0 321 866 A2, Gaugel, assigned to the assignee of the present application, discloses a single-based high-pressure discharge lamp, particularly suitable for automotive headlights, having a double-ended discharge vessel and a double-ended sealed outer envelope or shroud. The shroud completely encloses the discharge vessel. The current supply leads to the discharge vessel pass through pinch-sealed ends of the shroud.

The end of the outer envelope or shroud close to the base is supported by a metallic holder which, in turn, is located within a plastic base sleeve, and secured therein. It has been found that assembly of the outer envelope or shroud within the base, and attaching the discharge vessel within the envelope or shroud, is comparatively expensive and would unduly increase the cost of a mass-production item.

THE INVENTION

It is an object to provide a single-based high-pressure discharge lamp, particularly adapted for mobile applications and especially for an automotive headlight, which is simple to manufacture, while being sturdy and reliable in use.

Briefly, the lamp has the usual components of a base which includes a sleeve portion and an adjustable holder portion, to retain a double-ended discharge vessel and an outer envelope. The outer envelope and the discharge vessel are melt-connected to form a single structural unit.

In accordance with the present invention, a melt connection is formed between the envelope of the single structural unit and the holder portion of the base to thereby securely connect the single structural unit to the base. Preferably, the holder portion is formed with an extension, which can be strong and sturdy, projecting into the base and beyond a pinch connection of the outer envelope with the discharge vessel unit itself.

The high-pressure discharge lamp has a double-ended discharge vessel unit which defines, with respect to the base, a proximate end and a distal end. The outer envelope or bulb surrounds at least the discharge vessel portion of the discharge unit. The two elements of the light source, that is, the discharge vessel unit and the outer envelope or bulb, thus form a single structural unit. This single structural unit is secured within the base by melt-sealing the outer bulb or shroud in an adjustable holder portion, located within the base sleeve, so that the entire structural unit can be adjusted with respect to the base sleeve.

In comparison with the prior art, the structure is substantially more resistant to fracture when subjected to shock or vibration, while, additionally, having a base connection of the combined discharge vessel—outer envelope unit which is simple and easily manufactured.

In accordance with a feature of the invention, the outer envelope or shroud is melt-sealed within the holder portion of the base by using high-frequency induced heating of materials surrounding the outer envelope, for example the base material itself. This arrangement permits pre-adjusting the single unit formed by the discharge vessel and the outer bulb upon melt-connecting the outer bulb in the holder in order to ensure that, after such adjustment, the holder portion will be positioned in the base sleeve in such a way that the discharge arc within the discharge vessel bulb itself will be in a selected, e.g. the focal position of a reflector. Preferably, the outer envelope or bulb is formed with a tubular extension which extends the outer bulb beyond its proximate melt connection with the discharge vessel, and to permit this extension to be melt-connected within the holder portion of the base. This additionally increases the spacing of the discharge vessel bulb itself from the plastic base, and thus decreases the thermal loading on the base. Preferably, the outer bulb is formed with a profiled, for example ribbed, corrugated, or dimpled surface in the region of its extension in order to improve the adhesion of the outer bulb within the holder portion upon melt-connecting the two envelope-holder portion elements together.

DRAWING

The single figure is a highly schematic cross-sectional view through a single-based high-pressure discharge lamp illustrating a preferred embodiment of the invention, suitable for an automotive headlight lamp.

DETAILED DESCRIPTION

The discharge vessel unit 1 defines a gas-tightly closed discharge bulb portion 1*a*, which extends to a proximate pinch seal 1*b* and a distal pinch seal 1*c*. The pinch seals 1*b* and 1*c*, respectively, retain molybdenum foils 4, 5 which are electrically connected to current supply leads 6, 7 extending from the pinch seals 1*b*, 1*c*.

The lamp base 8, essentially, has a base sleeve 8*a* of plastic material and a holder portion 8*b* located within the base sleeve 8*a*, and adjustably retained therein. A ceramic bottom holder 8*c* is retained by means of metal spring clips 9 on the base sleeve 8*a*, and covers the holding portion 8*b* of the base. The end of the base sleeve 8*a*, remote from the discharge vessel unit 1, is formed as a connector with two plug terminals 10*a* and 10*b*.

An outer bulb 11 surrounds the discharge vessel unit 1.

In accordance with a feature of the invention, the outer shroud or envelope 11 is melt-connected to the distal end of the pinch seal 1*c* and, additionally, melt-connected at 111 to an essentially tubular extension 1*d* of the discharge vessel 1. The outer envelope or shroud 11 is formed with a tubular extension 11*a* which, at least in part, surrounds the tubular extension 1*d* of the discharge vessel unit 1. The proximate melt connection 111 between the outer envelope 11 and the discharge vessel unit 1 is, preferably, located adjacent to or just beyond the proximate pinch seal 1*b*. The tubular extension 11*a* of the outer envelope 11 is melt-connected in the holder portion 8*b* of the base 8. To effect such a melt connection, the holder portion 8*b* has a perforated metal cuff 12, or similar conductive material integrated therein. By application of high-frequency energy, the region surrounding the metallic cuff is heated to melting temperature, thus forming a tight melt connection 20 between the extension 11*a* of the envelope 11 and the holder portion 8*b* of the base. The melt connection 20 is best visible at the lower side of the Figure. The upper side of the drawing illustrates a profiled outer surface of the tubular extension 11*a*, for example formed by ridges, ribs, buttons, knobs or the like, shown at 11*b*, before that region of the holder portion 8*b* had melted.

The holder portion 8*b* is formed with a welding ring 14 which permits high-frequency induced weld connection of the socket sleeve 8*a* and the holder portion 8*b*. The proximate current supply lead 6, extending within the tubular extension 1*d* of the discharge unit 1, is electrically connected with a base terminal 10*b*; the distal current supply lead 7 is bonded, for example by welding or soldering with a current supply lead 13 extending parallel to the outer envelope 11, and into the base 8. The current supply lead 13 is electrically connected to the base terminal 10*a*; the portion extending parallel to the outer envelope 11 is surrounded by a ceramic insulation 13*a*. The electrical connection, preferably a weld or solder connection between the current supply return lead 13 and the distal current supply 7, is closed off by a cap 15, secured to the ceramic insulation 13*a* and the current supply lead 7. Cap 15 may be of plastic or ceramic, to protect the current supply lead 7 and its connection to connecting line 13 and to cover the end of the distal pinch seal 1*c* and the distal end of the outer sleeve 11, secured thereto.

The lamp is particularly adapted for use with a reflector, shown only schematically as R, and for example forming part of an automotive headlight.

The discharge vessel 1 is preferably made of quartz glass. The envelope 11, for cost reasons, may be made of hard glass having a thermal coefficient of expansion compatible with quartz glass or, likewise, may be made of quartz glass. Either one, the envelope or the discharge vessel units may be coated with suitable selectively transmitting and blocking radiation controlling coatings. The holder portion 8*b* of the base is formed with a reception region for the extension 11*b* of the envelope 11, the reception region 8*d* of the holder portion 8*b*, preferably, being formed as a recess within the holder portion 8*b*. The connection between the cap 15 and the distal current supply lead 7, preferably, is not tight to permit different thermal expansion of the discharge unit 1, the envelope 11, and the metallic connecting leads 7, 13, and to allow for some relative movement while still guiding the elements in their respective positions. The drawing shows cap 15 slightly raised from envelope 11 and discharge unit 1 for better visibility in the drawing.

Various changes and modifications may be made within the scope of the inventive concept.

We claim:

1. Single base, high-pressure discharge lamp having a base (8) including a base sleeve portion (8*a*), and an adjustable holder portion (8*b*) located within the base sleeve portion, and which is adjustable with respect to the base sleeve portion (8*a*);

a double-ended discharge vessel (1) defining a discharge bulb portion (1*a*), a proximate end portion (1*b*), and a distal end portion (1*c*);

an outer envelope (11) which is formed with a tubular extension (11*a*) surrounding at least the discharge bulb portion (1*a*) of the discharge vessel, said outer envelope being melt-connected (111) to the discharge vessel so that the discharge vessel (1) and the envelope (11) form a single structural unit (1, 11), and comprising a melt connection (20) between the envelope (11) of the single structural unit (1, 11) and the holder portion (8*b*) of the base (8), securely connecting and securing the single structural unit (1, 11) to the base (8);

wherein the holder portion (8*b*) of the base (8) is formed with a reception region for the outer envelope (11);

the reception region of the holder portion (8*b*) is formed of a meltable plastic material;

the melt connection being formed between the tubular extension (11*a*) of the outer envelope (11) and the holder portion (8*b*) of the base; and wherein the reception region of the holder portion (8*b*) includes means (12) subject to high-frequency induced heating from melting the holder portion (8*b*) of the base (8) and the outer envelope (11) together and form said melt connection.

2. The lamp of claim 1, wherein the outer surface of the envelope (11) in the region of the melt connection with the holder portion (8*b*) has a profiled shape (11*b*), optionally ridges, grooves, or knobs.

3. The lamp of claim 1, further including a cap element (15) of electrically insulating material located at the distal end of the discharge vessel (1), said cap covering an electrically conductive bonding connection, optionally a weld or solder connection, between a distal current supply lead (7) extending from the discharge vessel, and an electrical connection lead (13) extending to the base (8).

4. The lamp of claim 3, wherein the outer surface of the envelope (11) in the region of the melt connection with the holder portion (8*b*) has a profiled shape (11*b*), optionally ridges, grooves, or knobs.

* * * * *